US012371832B2

(12) United States Patent
Imaizumi

(10) Patent No.: US 12,371,832 B2
(45) Date of Patent: Jul. 29, 2025

(54) SEWING MACHINE AND STORAGE MEDIUM STORING PROGRAM FOR SEWING MACHINE THAT PERFORMS CIRCULAR STITCHING

(71) Applicant: BROTHER KOGYO KABUSHIKI KAISHA, Nagoya (JP)

(72) Inventor: Kazutaka Imaizumi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 18/637,065

(22) Filed: Apr. 16, 2024

(65) Prior Publication Data

US 2024/0263375 A1 Aug. 8, 2024

Related U.S. Application Data

(63) Continuation of application No. PCT/JP2022/037803, filed on Oct. 11, 2022.

(30) Foreign Application Priority Data

Oct. 22, 2021 (JP) ..... 2021-172917

(51) Int. Cl.
*D05B 35/00* (2006.01)
*D05B 19/16* (2006.01)

(52) U.S. Cl.
CPC ..... *D05B 35/00* (2013.01); *D05B 19/16* (2013.01)

(58) Field of Classification Search
CPC .... D05B 35/00; D05B 35/107; D05B 21/007; D05B 19/16; D05B 19/00; D05B 19/04;
(Continued)

(56) References Cited

U.S. PATENT DOCUMENTS 2,717,566 A * 9/1955 Szczepanski ..... D05B 35/107 112/470.11
7,527,005 B2 * 5/2009 Matsumoto ..... D05B 27/10 112/470.17

(Continued)

FOREIGN PATENT DOCUMENTS

JP 2010-178837 A 8/2010
JP 2014-023798 A 2/2014
JP 2020-005708 A 1/2020

OTHER PUBLICATIONS

Apr. 23, 2024 International Preliminary Report on Patentability issued in International Patent Application No. PCT/JP2022/037803.

(Continued)

*Primary Examiner* — Ismael Izaguirre
(74) *Attorney, Agent, or Firm* — Oliff PLC

(57) ABSTRACT

A circular stitching device is attachable to a bed of a sewing machine. The circular stitching device is configured to anchor a sewing workpiece in a rotatable manner at an anchor position that is apart from a needle drop position of a sewing needle by a distance corresponding to a size of a circular stitching pattern to be formed on the sewing workpiece. A projector is configured to project a projection image toward the bed. A controller is configured to perform controlling the projector to project the projection image representing at least part of the circular stitching pattern of the size to be formed on the sewing workpiece. The circular stitching pattern is formed by continuously arranging a unit pattern in a circular shape.

20 Claims, 13 Drawing Sheets

(58) Field of Classification Search
CPC ... D05B 3/00; D05B 3/04; D05B 3/24; D05B 3/243
See application file for complete search history.

(56) References Cited

U.S. PATENT DOCUMENTS

| | | | | |
|---|---|---|---|---|
| 2007/0206371 | A1* | 9/2007 | Yamasaki | D05B 79/00 362/90 |
| 2010/0192824 | A1 | 8/2010 | Matsumoto et al. | |
| 2014/0026794 | A1 | 1/2014 | Imaizumi et al. | |
| 2014/0182499 | A1* | 7/2014 | Matsushima | D05B 19/12 700/137 |
| 2019/0093267 | A1* | 3/2019 | Yamanashi | D05B 19/10 |
| 2020/0010994 | A1 | 1/2020 | Matsushima | |
| 2021/0156062 | A1* | 5/2021 | Matsushima | D05C 5/02 |

OTHER PUBLICATIONS

Nov. 29, 2022 International Search Report issued in International Patent Application No. PCT/JP2022/037803.

* cited by examiner

SEWING MACHINE AND STORAGE MEDIUM STORING PROGRAM FOR SEWING MACHINE THAT PERFORMS CIRCULAR STITCHING

REFERENCE TO RELATED APPLICATIONS

This is a Continuation Application of International Application No. PCT/JP2022/037803 filed on Oct. 11, 2022, which claims priority from Japanese Patent Application No. 2021-172917 filed on Oct. 22, 2021. The entire content of each of the prior applications is incorporated herein by reference.

BACKGROUND ART

A circular stitching device is known as an auxiliary part of a sewing machine for sewing a circular stitching pattern in which unit patterns are continuously arranged in a circular shape.

SUMMARY

For example, a sewing machine is configured to sew a circular stitching pattern using a circular stitching device. An image representing a circular stitching pattern to be sewn is displayed on a display provided on the sewing machine. A user checks the shape, size, and so on of the circular stitching pattern to be actually sewn from the image representing the circular stitching pattern displayed on the display.

However, the size of the display is limited because the area of a frame of the sewing machine in which the display is located is limited. Thus, when a circular stitching pattern larger than the size of the display is sewn, it is not easy to accurately know the shape, size, and so on of the circular stitching pattern to be actually sewn, from the image on the display.

In view of the foregoing, an example of an object of this disclosure is to provide a sewing machine configured to allow a user to accurately confirm the shape, size, and so on of a circular stitching pattern to be actually sewn by causing a projector provided in the sewing machine to project a projection image representing the circular stitching pattern of an actual size toward a bed.

According to one aspect, this specification discloses a sewing machine. The sewing machine includes a bed, a projector, and a controller. A circular stitching device is attachable to the bed. The circular stitching device is configured to anchor a sewing workpiece in a rotatable manner at an anchor position that is apart from a needle drop position of a sewing needle by a distance corresponding to a size of a circular stitching pattern to be formed on the sewing workpiece. The projector is configured to project a projection image toward the bed. The controller is configured to perform controlling the projector to project the projection image representing at least part of the circular stitching pattern of the size to be formed on the sewing workpiece. The circular stitching pattern is formed by continuously arranging a unit pattern in a circular shape. Thus, the sewing machine projects the projection image representing at least part of the circular stitching pattern of the size to be formed on the sewing workpiece. According to the sewing machine, the image representing the circular stitching pattern to be sewn, which is of an actual size, is projected by the projector. This enables a user to easily confirm the actual size of the circular stitching pattern to be sewn before sewing.

According to another aspect, this specification also discloses a non-transitory computer-readable storage medium storing a set of program instructions for a sewing machine including a bed to which a circular stitching device is attachable, a projector configured to project a projection image toward the bed, and a controller. The set of program instructions, when executed by the controller, causes the sewing machine to perform: determining a size of a circular stitching pattern, the circular stitching device being configured to anchor a sewing workpiece in a rotatable manner at an anchor position that is apart from a needle drop position of a sewing needle by a distance corresponding to the size of the circular stitching pattern to be formed on the sewing workpiece; identifying a unit pattern that forms the circular stitching pattern; generating the projection image representing at least part of the circular stitching pattern having the determined size, the circular stitching pattern being formed by continuously arranging the identified unit pattern in a circular shape; and controlling the projector to project the projection image. According to the non-transitory computer-readable storage medium storing a set of program instructions for the sewing machine, the above-described effects are also obtained.

DESCRIPTION

Figure 1:
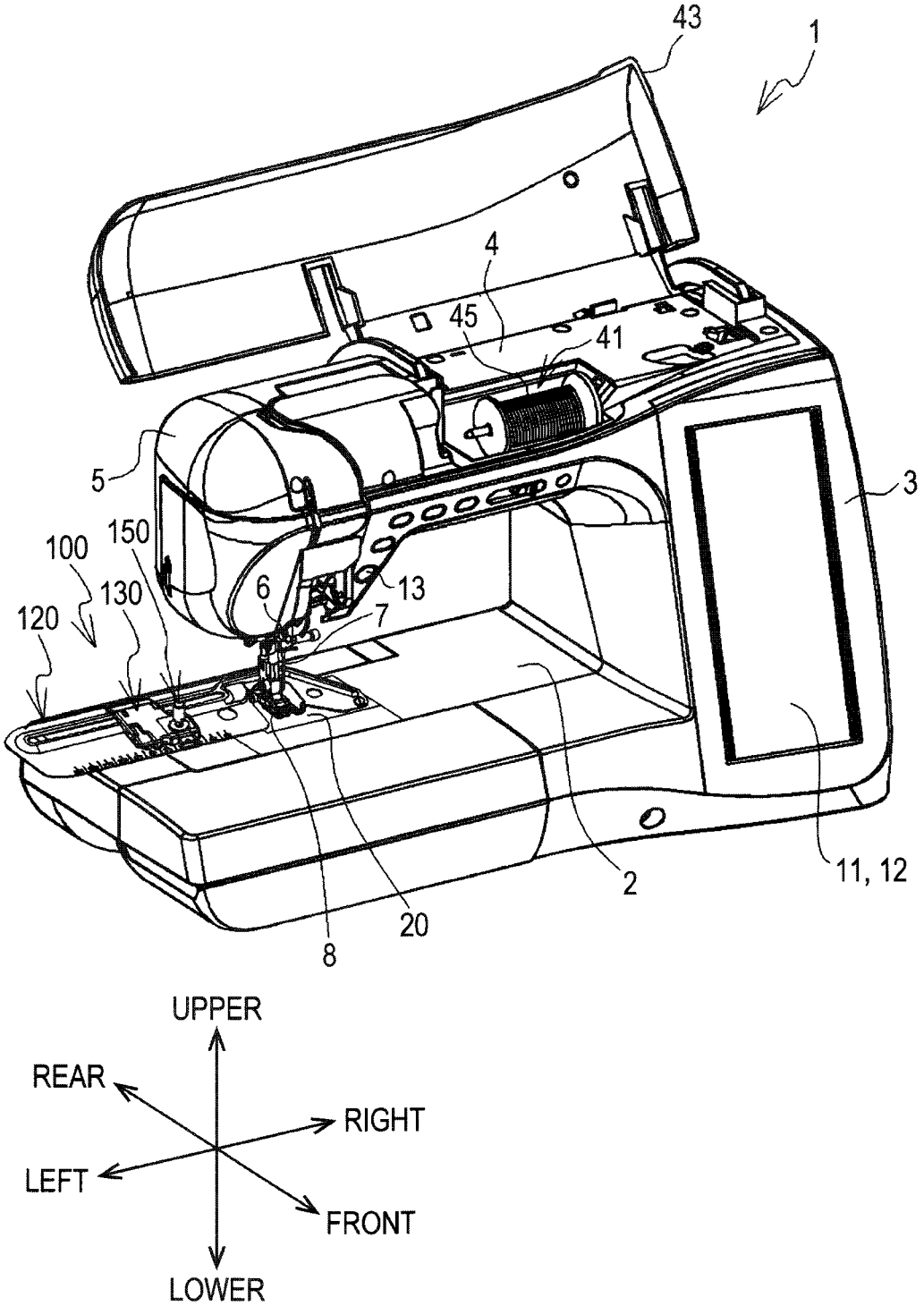
FIG. 1 is a perspective view of a sewing machine 1 to which a circular stitching device 100 is attached.

Hereinafter, embodiments of the present disclosure will be described with reference to the drawings. It should be noted that these drawings are used to describe the technical features of the present disclosure, and the configurations of the devices and so on described therein are merely examples for description. Hereinafter, directions used in the description are based on the directions described in the respective drawings.

<Mechanical Configuration of Sewing Machine 1>

A mechanical configuration of a sewing machine 1 will be described with reference to FIG. 1. The sewing machine 1 includes a bed 2, a column 3, an arm 4, and a head 5. The bed 2 is a base portion of the sewing machine 1 that extends in the left-right direction, and a needle plate 20 is installed on an upper surface of the bed 2. The column 3 is provided to stand upward from the right end of the bed 2. The arm 4 extends leftward from the upper end of the column 3 so as to face the bed 2. The head 5 is a portion connected to the left end of the arm 4.

A rectangular-shaped display 11 is provided on a front surface of the column 3. The display 11 displays an image including various items such as commands, illustrations, setting values, and message text. The front side of the display 11 is a touch panel 12 that detects an operated position. When a user operates the touch panel 12 with a finger or a dedicated touch pen, the operated position is detected, and an item in the image is selected. The user performs processes such as selection and editing of a pattern that the user wishes to sew by operating the touch panel 12.

A cover 43 configured to be opened and closed is provided on an upper portion of the arm 4. In FIG. 1, the cover 43 is in an opened state. A thread accommodating portion 41 is provided below the cover 43, that is, inside the arm 4. A thread spool 45 for supplying an upper thread is accommodated in the thread accommodating portion 41. A main drive shaft extending in the left-right direction is provided inside the arm 4. The main drive shaft is rotationally driven by a sewing machine motor 56. Various switches including a start-stop switch 13 are provided on a lower portion of the front surface of the arm 4. The start-stop switch 13 is used to start or stop an operation of the sewing machine 1, that is, to input an instruction to start or stop sewing.

Figure 2:
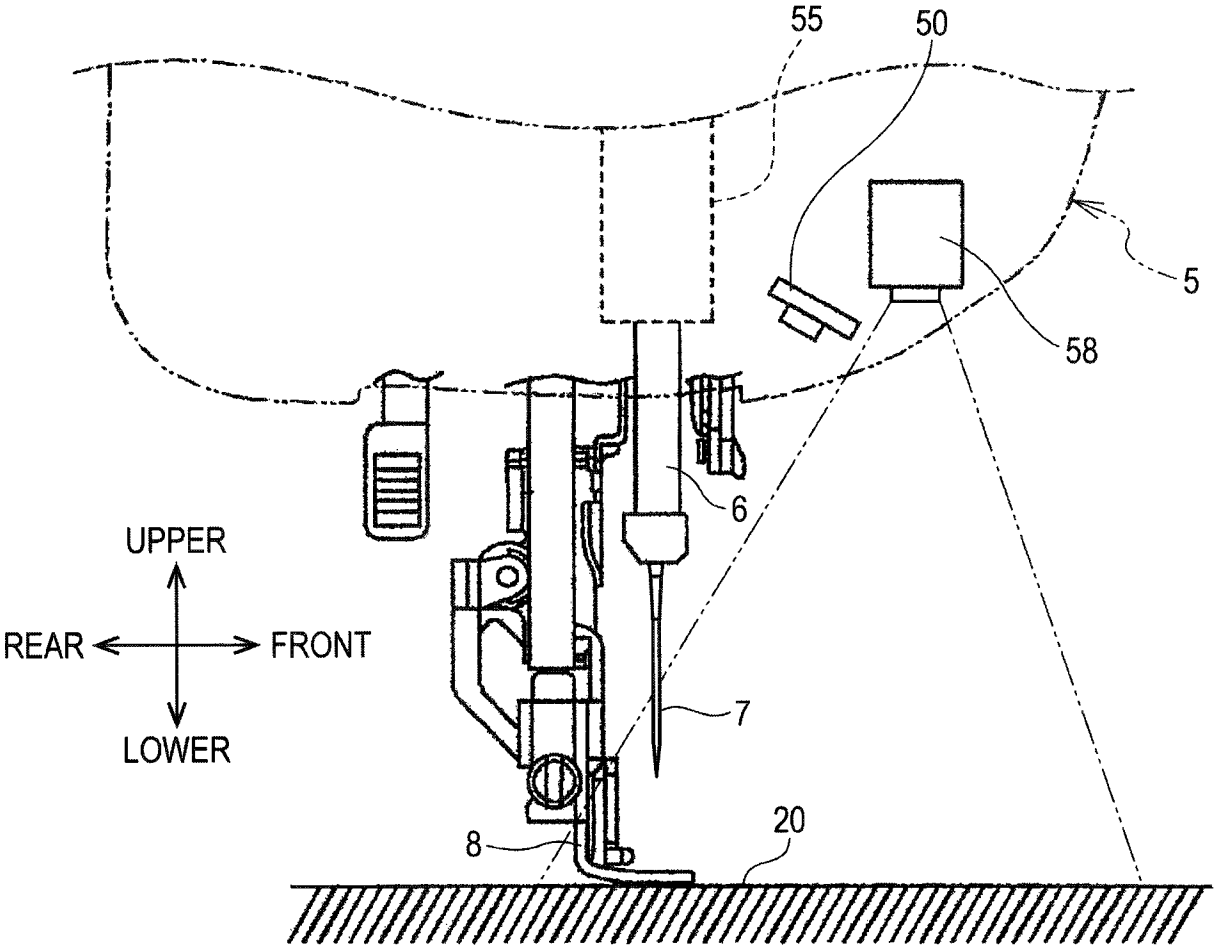
FIG. 2 is a left side view of a lower portion of a head 5.

Referring to FIG. 2, the mechanical configuration of the head 5 will be described. The head 5 includes a needle bar 6, a presser bar, a needle bar up-down movement mechanism 55, an image sensor 50, and a projector 58. A sewing needle 7 is detachably attached to the lower end of the needle bar 6. A presser foot 8 is detachably attached to the lower end of the presser bar. The needle bar up-down movement mechanism 55 drives the needle bar 6 in the upper-lower direction by rotation of the main drive shaft. When sewing, stitches are formed by moving the sewing needle 7 attached to the needle bar 6 up and down with respect to a sewing workpiece 400 fed by a feed dog 25.

The image sensor 50 captures an image of a particular range on the bed 2 and outputs a captured image. The output captured image is stored in an image storage portion 221 of a RAM 220 described later. A capturing range by the image sensor 50 is a size that enables the image sensor 50 to capture an image of a needle drop position of the sewing machine 1 and a through hole 141 in a state where a circular stitching device 100 described later is attached to the sewing machine 1 and a movable portion 130 is moved such that a scale mark 124 is at its maximum.

The projector 58 is configured to project an image onto a projection area set at a particular position on the bed 2 (the sewing workpiece 400). The projector 58 includes a cylindrical housing, and a liquid crystal panel 59, a light source 60, and an imaging lens (not shown) which are accommodated in the housing. The housing is fixed to a machine frame in the head 5. The light source 60 is an LED, for example. The liquid crystal panel 59 modulates light from the light source 60 and forms image light of a projection image based on image data representing the projection image. The imaging lens forms an image of the image light formed by the liquid crystal panel 59 on the projection area on the bed 2. A projection area PA of the present embodiment is a rectangular area that includes a needle drop position and an anchor position described later and that is arranged on the upstream side in a feed direction from the needle drop position, that is, on the front side of the sewing needle 7 shown in FIG. 2. The size of the projection area PA of the projector 58 of the present embodiment (for example, the lengths of the long sides and the short sides of the rectangular shape) is stored in an area storage portion 202 of a ROM 200 in advance.

<Circular Stitching Device 100>

The circular stitching device 100 will be described with reference to FIGS. 1 and 3. The circular stitching device 100 is a device that is attached to the sewing machine 1 and is a device that enables circular stitches to be formed while rotating a sewing workpiece about the anchor position (hereinafter referred to as circular stitching). The anchor position is a position that is apart from the needle drop position and is a position where the sewing workpiece 400 is rotatably anchored. The circular stitching device 100 exemplified in the present embodiment has the same configuration as the circular stitching device disclosed in U.S. Patent Application Publication No. 2014/0026794 (corresponding to Japanese Patent Application Publication No. 2014-023798). As shown in FIG. 1, the circular stitching device 100 includes a main body 120, the movable portion 130 movably held by the main body 120, and a pivot pin 150 detachably attached to the movable portion 130.

The main body 120 is configured by a thin plate member that is substantially rectangular in a plan view and is configured to be attachable to and detachable from the upper surface of the needle plate 20. As shown in FIG. 3, the main body 120 has a recess 123 recessed rearward from the front end in the vicinity of the right end of the main body 120. An attaching portion 121 is disposed on the right side of the recess 123. A guide portion 122 is connected to the left end of the attaching portion 121 and extends leftward.

The attaching portion 121 is fixed to the needle plate 20 with a screw 129 at the right end thereof. The main body 120 is disposed such that a needle hole 21 and rectangular holes are located inside the recess 123. The main body 120 is fixed to the needle plate 20. When the presser foot 8 is moved downward to press the sewing workpiece 400, the presser foot 8 is disposed inside the recess 123. The guide portion 122 movably holds the movable portion 130.

Along the front end of the guide portion 122, the scale marks 124 are provided at particular intervals (for example, intervals of 5 mm). The scale marks 124 are used as a guide for positioning the movable portion 130 with respect to a needle drop position which is a position at which the sewing needle 7 pierces the sewing workpiece 400. A rail groove 125, which is an opening extending linearly in the left-right direction, is provided in a rear portion of the guide portion 122. A plurality of V-shaped grooves are formed at particular intervals (for example, intervals of 5 mm) along the front end of the rail groove 125.

The movable portion 130 is an L-shaped member in a plan view, has a length in the left-right direction of approximately one quarter of the guide portion 122, and has a height larger than the length of a needle of the pivot pin 150. An engaging portion 135 protruding downward is provided at a rear portion of the movable portion 130. The engaging portion 135 is configured to be movable along the rail groove 125 of the guide portion 122 and to be engageable with the V-shaped groove. The engaging portion 135 is moved in the left-right direction along the rail groove 125 and engages with one of the V-shaped grooves, whereby the movable portion 130 is held at a position corresponding to one of the scale marks. A triangular marker 133 protruding forward is provided at a center portion of the movable portion 130 in the left-right direction. The value of the scale mark 124 indicated by the marker 133 indicates the radius of a stitching pattern of a circular shape (hereinafter, referred to as a circular stitching pattern) formed on the sewing workpiece 400 by circular stitching.

A pin holder 131 having a substantially rectangular shape in a plan view is provided on a right front portion of the movable portion 130. The through hole 141 through which the needle of the pivot pin 150 is inserted and an indicator 140 are formed on the upper surface of the pin holder 131. The indicator 140 has grooves extending radially in three directions at intervals of 120 degrees in a Y shape with the through hole 141 as a center. Each of the three grooves of the indicator 140 is a shallow linear groove. The indicator 140 has a function of guiding insertion of the needle of the pivot pin 150 into the through hole 141 and a function of indicating the position of the through hole 141 so that the user easily recognizes the position of the through hole 141. In the present embodiment, the indicator 140 is an identification target in a captured image, and thus, the three grooves may be colored in a color different from the color of the surroundings in order to facilitate identification.

Although not shown, anchoring claws are provided below the pin holder 131 inside the movable portion 130. The anchoring claws hold the needle of the pivot pin 150 inserted into the through hole 141 by clamping the needle from the left and right by an urging force of a coil spring. An operation portion 132 is provided on the front side of the pin holder 131. The operation portion 132 is configured to release the hold of the anchoring claws when the operation portion 132 is pressed rearward.

When the needle of the pivot pin 150 is inserted into the through hole 141 of the pin holder 131 from the tip end side, the pivot pin 150 is held by the movable portion 130 by the anchoring claws inside the pin holder 131. In the present embodiment, since the pivot pin 150 is an identification target in the captured image, at least the pivot pin 150 may be colored in a color different from the color of the pin holder 131 in order to facilitate identification.

Figure 3:
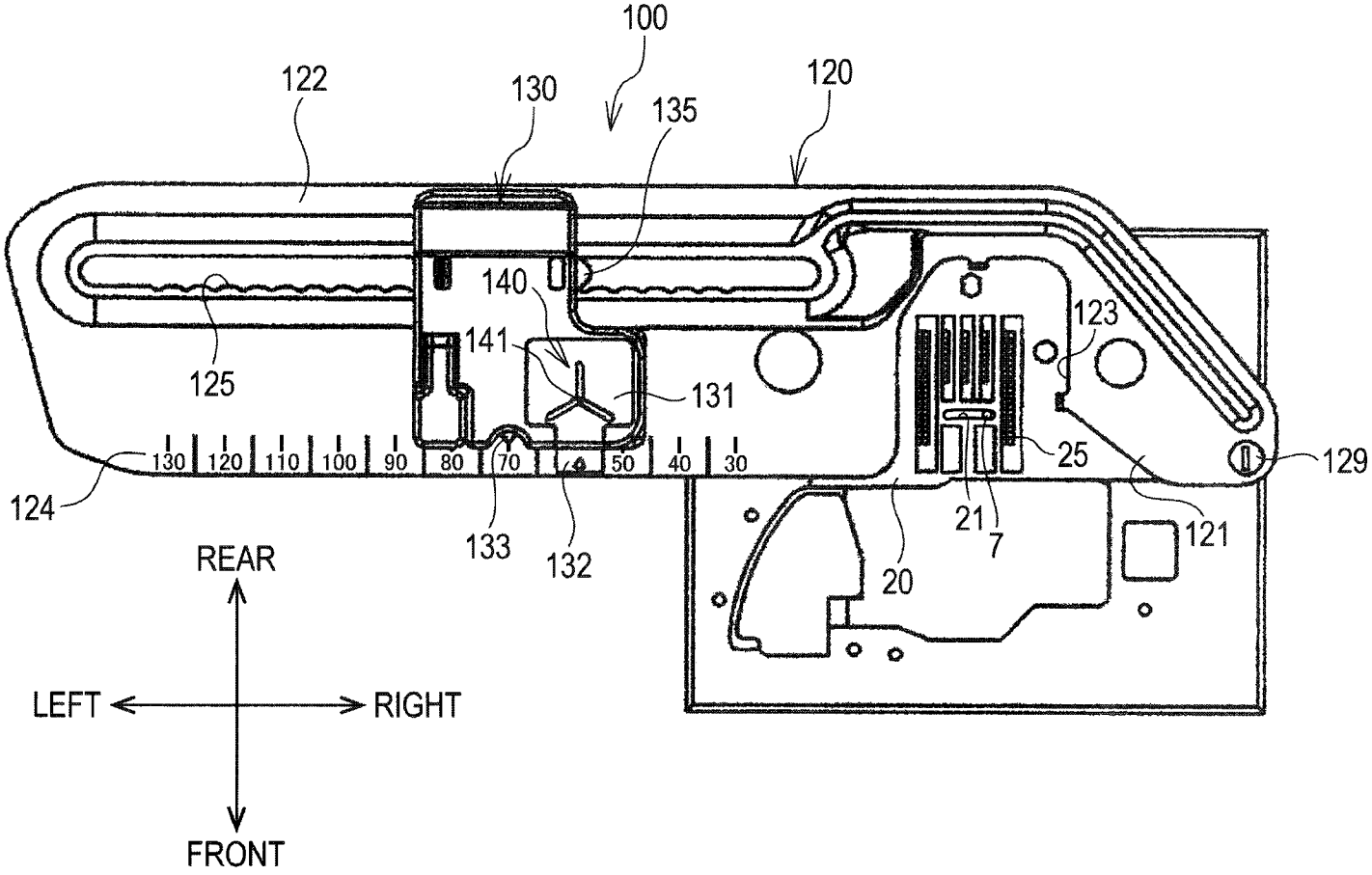
FIG. 3 is a plan view of the circular stitching device 100 in a state where a pivot pin 150 is not attached.

Referring to FIGS. 1 and 3, a method of using the circular stitching device 100 will be described. As shown in FIG. 1, the user first attaches the circular stitching device 100 onto the bed 2 by fixing the attaching portion 121 of the main body 120 to the needle plate 20 with the screw 129. Then, as shown in FIG. 3, in a state where the pivot pin 150 is not attached, while checking the scale marks 124, the user moves the movable portion 130 in the left-right direction along the rail groove 125 to a position where the marker 133 indicates a value corresponding to the radius of a desired circular stitching pattern. The radius of the circular stitching pattern is a distance between the needle drop position and the position of the through hole 141 into which the needle of the pivot pin 150 is inserted, that is, the anchor position of the sewing workpiece 400. In the circular stitching device 100 shown in FIG. 3, the position indicated by the marker 133 and the position of the through hole 141 are different in the left-right direction, but the circular stitching device 100 is configured such that the value of the scale mark 124 indicated by the marker 133 matches the radius of the circular stitching pattern that is actually formed.

After the marker 133 is moved, the user sets the sewing workpiece 400 so as to cover the circular stitching device 100 attached to the bed 2 in a state where the pivot pin 150 is not attached. The user sticks the needle of the pivot pin 150 to a position that is the center position of the circular stitching pattern on the sewing workpiece 400, and further sticks the needle that is stuck into the sewing workpiece 400 into the through hole 141 of the pin holder 131. The anchoring claws inside the pin holder 131 pinch and hold the needle, and thus the sewing workpiece 400 is anchored at the position of the through hole 141, that is, the position of the needle at the center of the pivot pin 150 in a plan view. FIG. 1 shows a state where the needle of the pivot pin 150 is inserted into the through hole 141 in a state where the sewing workpiece 400 is omitted for convenience of illustration.

The sewing workpiece 400 is pressed by the pivot pin 150, but is in a state of being rotatable about the needle of the pivot pin 150 when the feed dog 25 is driven. In this state, the user selects a desired pattern and causes the sewing machine 1 to start a sewing operation, whereby circular stitching is performed.

<Electrical Configuration of Sewing Machine 1>

Figure 4:
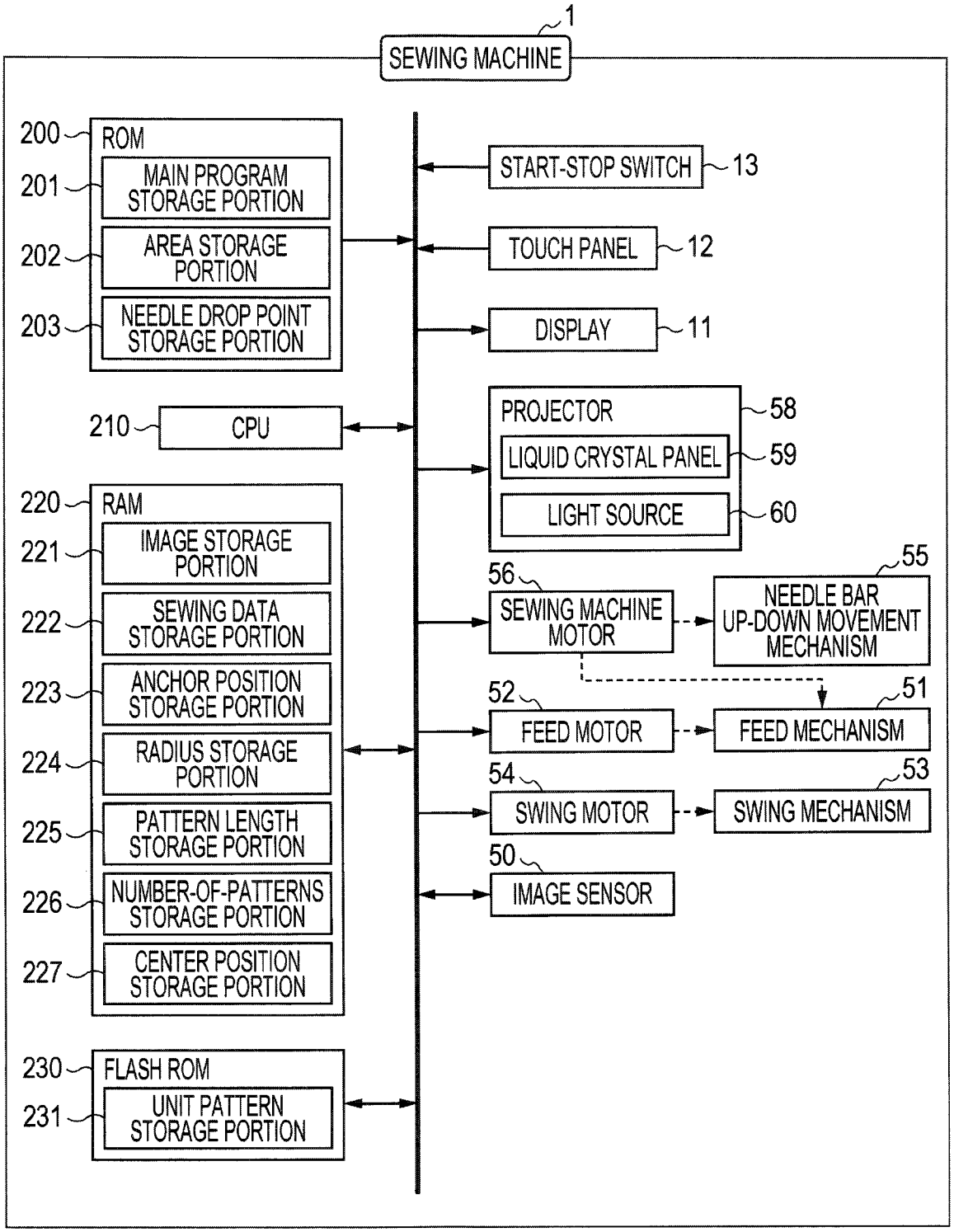
FIG. 4 is a block diagram showing an electrical configuration of the sewing machine 1.

An electrical configuration of the sewing machine 1 will be described with reference to FIG. 4. The sewing machine 1 includes the ROM 200, a CPU 210, the RAM 220, and a flash ROM 230 as a sewing machine controller.

The ROM 200 stores a boot program, a BIOS, and so on. The ROM 200 includes a main program storage portion 201, the area storage portion 202, and a needle drop point storage portion 203. The main program storage portion 201 stores a main program that is a program for the CPU 210 to control the sewing machine 1. The area storage portion 202 stores a size of the projection area PA, which is the maximum range that can be projected by the projector 58. For example, the projection area PA in the present embodiment has a rectangular shape with a long side of approximately 12.7 cm and a short side of approximately 7.6 cm, and the lengths of the long side and the short side are stored in the area storage portion 202. In the present embodiment, the sewing machine 1 sets one of a left needle drop point, a center needle drop point, and a right needle drop point as the needle drop position that serves as the reference for pattern formation in a range in which the needle bar 6 is swung. In FIG. 3, the sewing needle 7 located at the right needle drop point is shown. The needle drop point storage portion 203 stores position coordinates of each needle drop point in a sewing machine coordinate system described later. The RAM 220 includes the image storage portion 221, a sewing data storage portion 222, an anchor position storage portion 223, a radius storage portion 224, a pattern length storage portion 225, a number-of-patterns storage portion 226, and a center position storage portion 227. The flash ROM 230 includes a unit pattern storage portion 231. The unit pattern storage portion 231 stores sewing data for sewing each of a plurality of types of unit patterns and unit pattern images representing the respective unit patterns, for unit patterns that constitute circular stitching patterns. The unit pattern is, for example, a utility pattern such as zigzag stitches or a decorative pattern representing a leaf of a plant and so on.

In addition to the sewing machine controller, the start-stop switch 13, the touch panel 12, the display 11, the projector 58, the sewing machine motor 56, a feed motor 52, a swing motor 54, and the image sensor 50 are electrically connected to the sewing machine controller.

The front surface of the display 11 is configured by the touch panel 12. The user operates the touch panel 12 with his/her finger or a touch pen. The projector 58 includes the liquid crystal panel 59 and the light source 60.

The sewing machine motor 56 is connected to the needle bar up-down movement mechanism 55 and a feed mechanism 51, and the feed motor 52 is connected to the feed mechanism 51 in order to adjust a feed amount. Thus, the needle bar up-down movement mechanism 55 moves the needle bar 6 up and down in accordance with rotation of the sewing machine motor 56, and the feed mechanism 51 feeds the sewing workpiece 400 by the sewing machine motor 56 and the feed motor 52. The swing motor 54 is connected to a swing mechanism 53. Thus, the swing mechanism 53 causes the needle bar 6 to swing in a direction perpendicular to the feed direction by the swing motor 54. The sewing machine 1 is configured to sew patterns of various shapes on the sewing workpiece 400 by the needle bar up-down movement mechanism 55, the feed mechanism 51, and the swing mechanism 53.

<Main Process>

Figure 5:
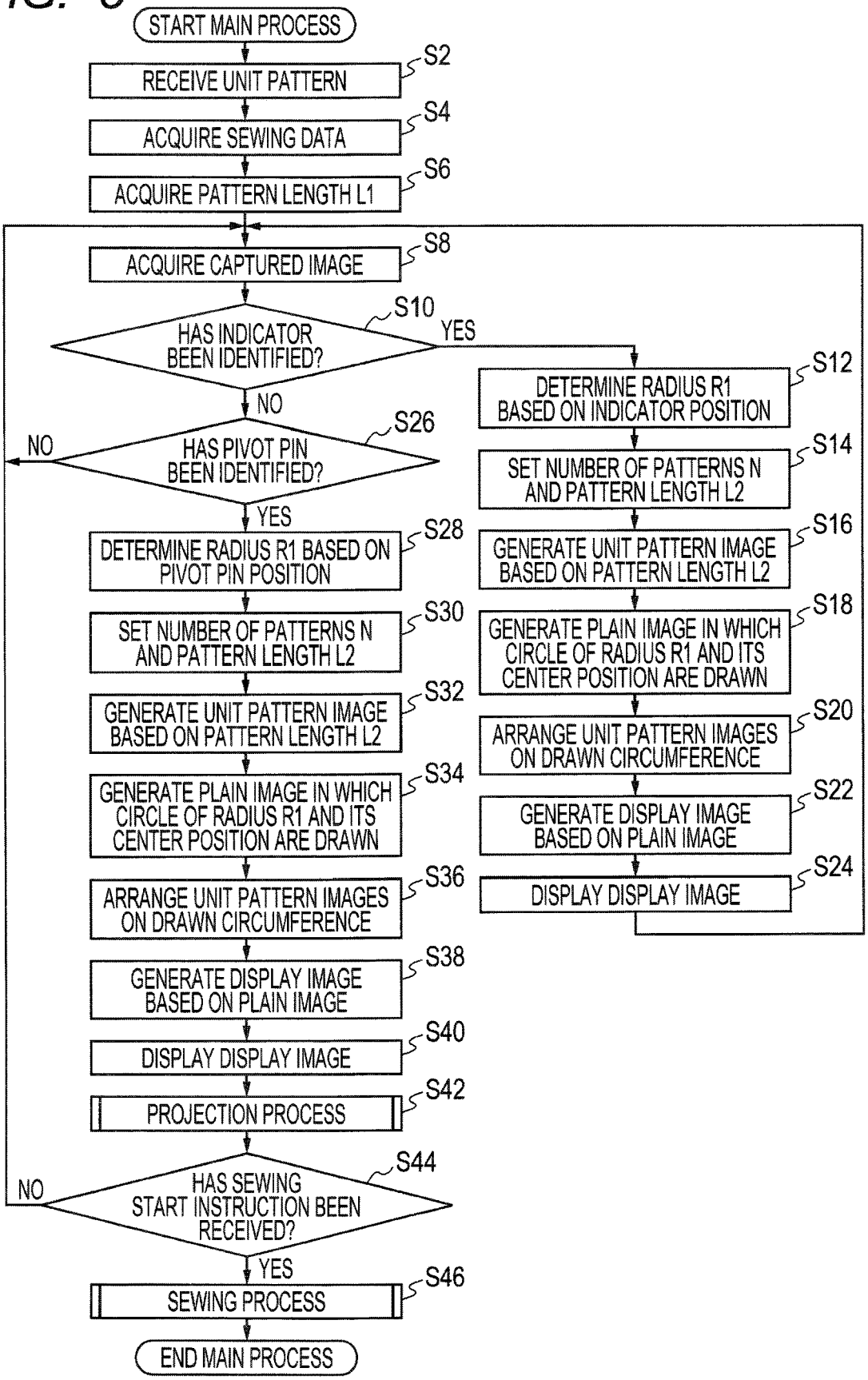
FIG. 5 is a flowchart showing a main process of the sewing machine 1.

An operation of a main process that is performed by the sewing machine 1 will be described in accordance with the flowchart shown in FIG. 5. When the user presses a power switch of the sewing machine 1, the CPU 210 performs the main program stored in the main program storage portion 201, and the main process is started. The CPU 210 of the sewing machine 1 performs each of the processes of a series of processes indicated by S2 to S46 in FIG. 5.

In the present embodiment, a sewing machine coordinate system, a captured image coordinate system, a projection coordinate system, and a plain coordinate system are used as coordinate systems. The sewing machine coordinate system is a rectangular XY coordinate system representing position coordinates on the bed 2 with a particular position on the bed 2 as an origin. The captured image coordinate system is a rectangular XY coordinate system representing position coordinates of a captured image captured by the image sensor 50. The projection coordinate system is a rectangular XY coordinate system representing the position coordinates of a projection image PAG1 projected by the projector 58. The plain coordinate system is a rectangular XY coordinate system representing the position coordinates of a plain image PG1. The position coordinates of the sewing machine coordinate system and the position coordinates of each of the captured image coordinate system, the projection coordinate system, and the plain coordinate system are transformable into each other. For example, when the captured image coordinate system is transformed into the sewing machine coordinate system, coordinate transformation parameters are determined based on the origin position coordinates of the respective coordinate systems, the inclination of the coordinate axis, and so on. The position coordinates of the captured image coordinate system are transformed into position coordinates of the sewing machine coordinate system by a known coordinate transformation technique using the determined coordinate transformation parameters.

The CPU 210 reads unit pattern images of a plurality of types of unit patterns stored in the unit pattern storage portion 231, and displays the unit pattern images on the display 11. The user operates the touch panel 12 to select a unit pattern image representing a desired unit pattern TP from among the unit pattern images displayed on the display 11 (S2). For example, the unit pattern TP shown in FIG. 6 is a utility pattern in which three ridges formed by zigzag stitches are continuously arranged, and is a pattern in which the right needle drop point is used as a needle drop position NP1 that is the reference for pattern formation.

The CPU 210 acquires sewing data for sewing the unit pattern TP corresponding to the unit pattern image selected in S2 by reading the sewing data from the unit pattern storage portion 231 (S4). The read sewing data is stored in the sewing data storage portion 222 of the RAM 220. The sewing data includes feed amount data indicating a planned feed amount of the sewing workpiece 400 by the feed dog 25, and swing amount data indicating a planned swing amount of the needle bar 6 by the swing mechanism 53. More specifically, the planned feed amount is a target value of a movement distance in the feed direction of the sewing workpiece 400 that is required when forming each of the stitches of the unit pattern TP. In the present embodiment, the feed amount data is data indicating the number of drive pulses (including a motor rotation direction) to be supplied to the feed motor 52 in order to feed the sewing workpiece 400 by the planned feed amount. The swing amount data is data indicating the number of drive pulses (including a motor rotation direction) to be supplied to the swing motor 54 in order to form each stitch of the unit pattern TP.

Figure 6:
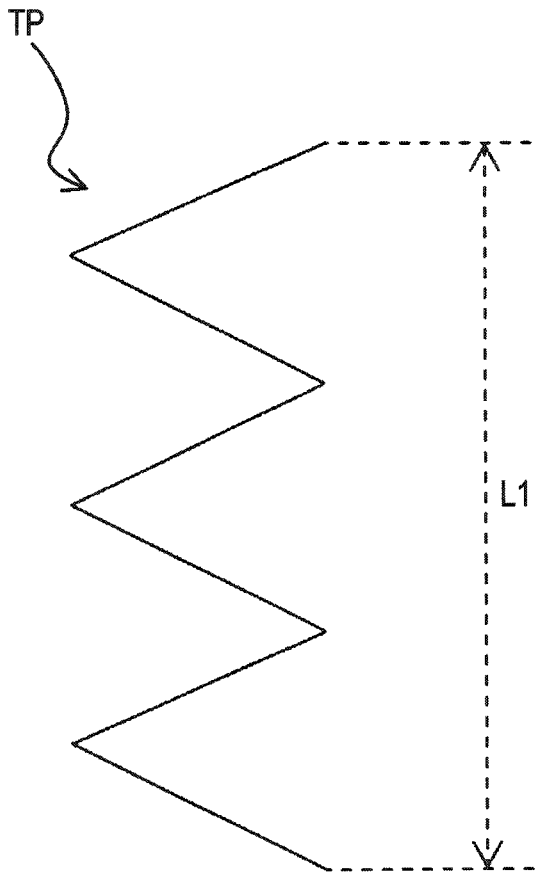
FIG. 6 is an explanatory diagram showing a unit pattern TP.

As shown in FIG. 6, the CPU 210 acquires a pattern length L1 indicating the length of an entirety of the unit pattern TP (S6). For example, the pattern length L1 is calculated by adding all the planned feed amounts of the stitches forming the unit pattern TP based on the feed amount data of sewing data stored in the sewing data storage portion 222. The acquired pattern length L1 is stored in the pattern length storage portion 225 of the RAM 220.

The CPU 210 controls the image sensor 50 to capture an image of the bed 2 and acquires a captured image (S8). In the present embodiment, the captured image is an image obtained by capturing the periphery of the actual needle drop position. The acquired captured image is stored in the image storage portion 221 of the RAM 220.

The CPU 210 performs an identification process of identifying the indicator 140 from the captured image stored in the image storage portion 221, and determines whether the indicator 140 has been identified (S10). Any known image recognition method may be used as the identification process of the indicator 140. For example, as a series of processes of the image recognition method, lines in the captured image are detected by edge extraction. Thereafter, a pattern matching is performed to compare the detected lines with a template indicating the shape of the three grooves of the indicator 140 which is stored in the flash ROM 230 in advance. As a result, if there is a portion including lines having substantially the same shape as the template, the portion is identified as the indicator 140. In response to determining that the indicator 140 has been identified in the captured image (S10: YES), the CPU 210 advances the processing to S12. Note that, when the circular stitching device 100 is attached to the bed 2 and the sewing workpiece 400 is not set on the circular stitching device 100, the CPU 210 identifies the indicator 140. In response to determining that the indicator 140 has not been identified in the captured image (S10: NO), the CPU 210 advances the processing to S26.

In response to determining that the indicator 140 has been identified in the captured image (S10: YES), the CPU 210 determines a radius R1 of a circular stitching pattern SP (S12). The point at which the three grooves of the indicator 140 intersect corresponds to the position of the through hole 141, that is, the anchor position at which the sewing workpiece 400 is anchored by the needle of the pivot pin 150. Circular stitching is performed with the anchor position as the rotation center of the sewing workpiece 400. Thus, the CPU 210 calculates the distance between the needle drop position and the point (the position of the through hole 141) where the three grooves of the indicator 140 intersect in the captured image, and determines the calculated distance as the radius R1 of the circular stitching pattern SP. Since the image sensor 50 is fixedly installed at the sewing machine 1, a capturing range is also fixed. In the present embodiment, the sewing machine 1 automatically sets, as the first needle drop position NP1 that serves as the reference for forming the unit pattern TP, one of the left needle drop point, the center needle drop point, and the right needle drop point in the range in which the needle bar 6 is swung, depending on each unit pattern. Which needle drop point is the first needle drop position differs depending on the unit pattern. In the case of the unit pattern TP (FIG. 6), the right needle drop point is the first needle drop position NP1. If the capturing range does not change, the position of each needle drop point in the captured image is also fixed. The CPU 210 reads the position coordinates of the needle drop point corresponding to the selected unit pattern TP from among the position coordinates indicating the needle drop points of the sewing machine coordinate system stored in the needle drop point storage portion 203 of the ROM 200. The CPU 210 transforms the read position coordinates of the needle drop point of the sewing machine coordinate system into the position coordinates of the captured image coordinate system, thereby determining the position coordinates of the needle drop position NP1 of the captured image coordinate system.

The CPU 210 sets a number of patterns N of the unit pattern TP constituting the circular stitching pattern and a pattern length L2 in the feed direction (S14). The set number of patterns N is stored in the number-of-patterns storage portion 226 of the RAM 220, and the pattern length L2 is stored in the pattern length storage portion 225 of the RAM 220. The number of patterns N and the pattern length L2 may be calculated by a method described in U.S. Patent Application Publication No. 2014/0026794 (corresponding to Japanese Patent Application Publication No. 2014-023798), for example. The calculation method will be briefly described below. First, a circumferential length L of a circle PS1 having the radius R1 is obtained by the following equation. In the following equation, 3.1415 is used as the circular constant π for simplification.

$$L = 2 \times 3.1415 \times R1$$

The CPU 210 reads the pattern length L1 stored in the pattern length storage portion 225 in S6. In a case where a value N1 obtained by the following equation is an integer, the N1 unit patterns TP having the pattern length L1 are arranged along the circumference of the circle having the circumferential length L without gaps in order to form the circular stitching pattern SP. Thus, in this case, N1 is set as the number of patterns N, and the pattern length L1 is set as the pattern length L2 as they are (N=N1, L2=L1).

$$N1 = L/L1$$

In a case where the value N1 obtained by the above equation is not an integer, the plurality of unit patterns TP cannot be arranged without gaps along the circumference of the circle PS1 having the radius R1 unless the pattern length L1 is changed. Thus, a value obtained by rounding off N1 to the nearest whole number is set as the number of patterns N. Further, the pattern length L2 is calculated based on the following equation. That is, the pattern length L2 is obtained such that the length of the N unit patterns TP of the pattern length L2 is equal to the circumferential length L of the circle PS1 of the radius R1.

$$L2 = L1 + \{L - (N \times L1)\}/N$$

For example, in a case where the original pattern length L1 of the unit pattern TP is 20 mm and the radius R1 of the circular stitching pattern SP is 50 mm, the circumferential length L is 314.15 mm, and thus the value N1 is 15.7 and is not an integer. Thus, the number of patterns N is set to 16. In this case, since the length of 16 unit patterns TP is equal to 320 mm, the difference from the circumferential length L, that is, 5.85 mm is distributed to the 16 unit patterns TP. That is, the pattern length L2 of the unit pattern TP is set to 19.63 mm (=20–5.85/16).

The CPU 210 newly generates a unit pattern image of the pattern length L2 based on the pattern length L2 stored in the pattern length storage portion 225 (S16). For example, the unit pattern image of the pattern length L2 is generated by a known image scaling process, based on the unit pattern image of the pattern length L1 stored in the unit pattern storage portion 231. The generated unit pattern image of the pattern length L2 is stored in the image storage portion 221.

The CPU 210 generates a plain image in which the circle PS1 of the radius R1 and a center position CP1 of the circle PS1 are drawn (S18). The center position CP1 indicates the position of the through hole 141 of the indicator 140, that is, the anchor position in the circular stitching. The CPU 210 draws the circle PS1 such that the intersection of the diagonal lines of the plain image is the center position CP1 of the circle PS1. The plain image is an image for representing the circular stitching pattern in a size to be actually sewn. The plain image has a size capable of drawing the circular stitching pattern that is generated from the maximum value of the radius set by the circular stitching device 100. The plain image is a square image shown in FIG. 7. The CPU 210 stores the position coordinates of the center position CP1 in the plain coordinate system in the center position storage portion 227 of the RAM 220.

Figure 7:
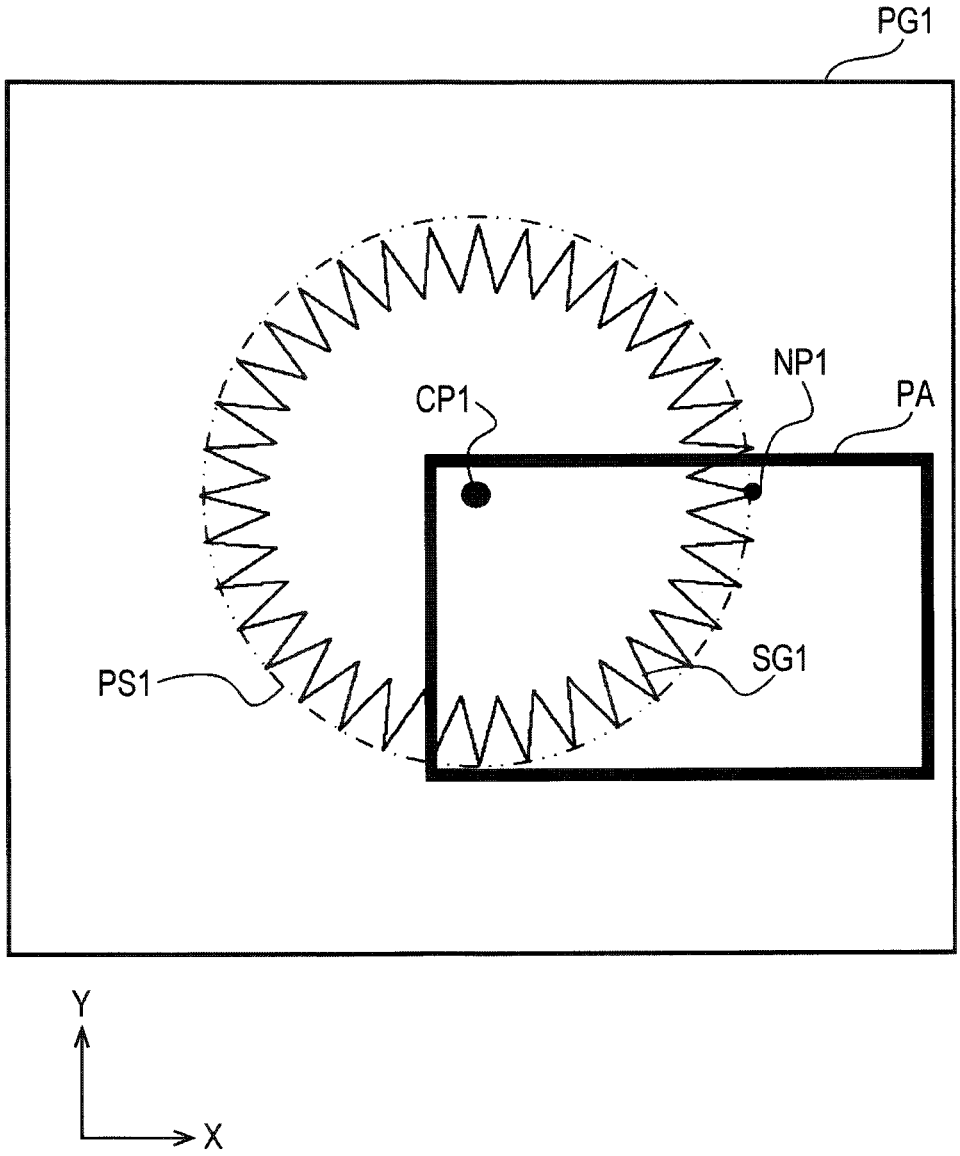
FIG. 7 is an explanatory diagram showing a plain image PG1 including a circular stitching pattern image SG1 formed along a circumference of a circle PS1.

The CPU 210 arranges the unit pattern images of the pattern length L2 stored in the image storage portion 221 on the circumference of the circle PS1 in the plain image generated in S18 (S20). The plain image PG1 shown in FIG. 7 is a plain image in a case where the unit pattern images representing the unit pattern TP shown in FIG. 6 are arranged on the circumference of the circle PS1. A circular stitching pattern image SG1, the needle drop position NP1, and the center position CP1 are drawn in the plain image PG1. The unit pattern images are arranged with the needle drop position NP1 in the plain image PG1 as a formation start point. For example, the needle drop position NP1 is determined by deriving an intersection point between a straight line extending horizontally in the X-axis positive direction from the center position CP1 and the circumference of the circular stitching pattern image SG1, that is, the circle PS1 on which the unit pattern images are arranged. The center position CP1 corresponds to the actual anchor position. The projection area PA indicates an area that is projected by the projector 58, and will be described in detail later.

The CPU 210 generates a display image based on the plain image PG1 (S22). The display image is an image that is displayed on the display 11 and that indicates the shape of the circular stitching pattern SP. For example, the display image showing the shape of the circular stitching pattern SP is generated by enlarging or reducing the plain image PG1 to a size that is displayable on the display 11. The generated display image is stored in the image storage portion 221.

The CPU 210 displays the display image stored in the image storage portion 221 on the display 11 (S24). Thereafter, the CPU 210 returns the processing to S8.

In a case where the circular stitching device 100 is not attached to the sewing machine 1, the CPU 210 does not identify the indicator 140. In addition, in a case where the sewing workpiece 400 is set on the circular stitching device 100, the CPU 210 does not identify the indicator 140. That is, in response to determining that the indicator 140 has not been identified in S10 (S10: NO), the CPU 210 performs an identification process of identifying the pivot pin 150 from the captured image stored in the image storage portion 221, and determines whether the pivot pin 150 has been identified (S26). As in the identification process of the indicator 140, any known image recognition method may be used as the identification process of the pivot pin 150. For example, an image recognition method similar to the identification process of the indicator 140 is used. In response to determining that the pivot pin 150 has been identified (S26: YES), the CPU 210 stores the position coordinates of the pivot pin 150 of the captured image coordinate system as the anchor position in the anchor position storage portion 223, and advances the processing to S28. In response to determining that the pivot pin 150 has not been identified (S26: NO), the CPU 210 returns the processing to S8. For example, in a case where the sewing workpiece 400 is set on the circular stitching device 100 by the pivot pin 150 as described above, the CPU 210 identifies the pivot pin 150 (S10: NO, S26: YES). In a case where the circular stitching device 100 is not attached to the sewing machine 1, neither the indicator 140 nor the pivot pin 150 is identified (S10: NO, S26: NO).

In response to determining that the pivot pin 150 has been identified (S26: YES), the CPU 210 determines the radius R1 of the circular stitching pattern SP (S28). The point at which the three grooves of the indicator 140 intersect corresponds to the position of the through hole 141, that is, the anchor position at which the sewing workpiece 400 is anchored by the needle of the pivot pin 150. Thus, the radius R1 of the circular stitching pattern SP is determined by replacing the point (the through hole 141) where the three grooves of the indicator 140 intersect in the captured image in S12 with the center position of the pivot pin 150 (the position of the needle of the pivot pin 150) and performing the same processing.

The processes of S30, S32, S34, S36, S38 and S40 are performed similarly to S14, S16, S18, S20, S22 and S24. However, after the display image is displayed in S24, the CPU 210 returns the processing to S8, but after the display image is displayed in S40, the CPU 210 advances the processing to S42.

The CPU 210 performs a projection process (S42). The projection process will be described in detail later.

After performing the projection process, the CPU 210 determines whether a sewing start instruction has been received (S44). When the user presses the start-stop switch 13, the CPU 210 receives a signal instructing to start sewing, and determines that the sewing start instruction has been received. When the user operates the touch panel 12 and touches a "return" button, the CPU 210 determines that the sewing start instruction has not been received. In response to determining that the sewing start instruction has been received (S44: YES), the CPU 210 advances the processing to S46. In response to determining that the sewing start instruction has not been received (S44: NO), the CPU 210 returns the processing to S8.

In response to determining that the sewing start instruction has been received (S44: YES), the CPU 210 performs the sewing process (S46). The sewing process will be described in detail later. After the sewing process is performed, the CPU 210 ends the main process. When the main process ends, the CPU 210 also ends the projection of the projection image PAG1. That is, due to end of sewing of the circular stitching pattern SP, the projection of the projection image PAG1 also ends.

<Projection Process>

Figure 8:
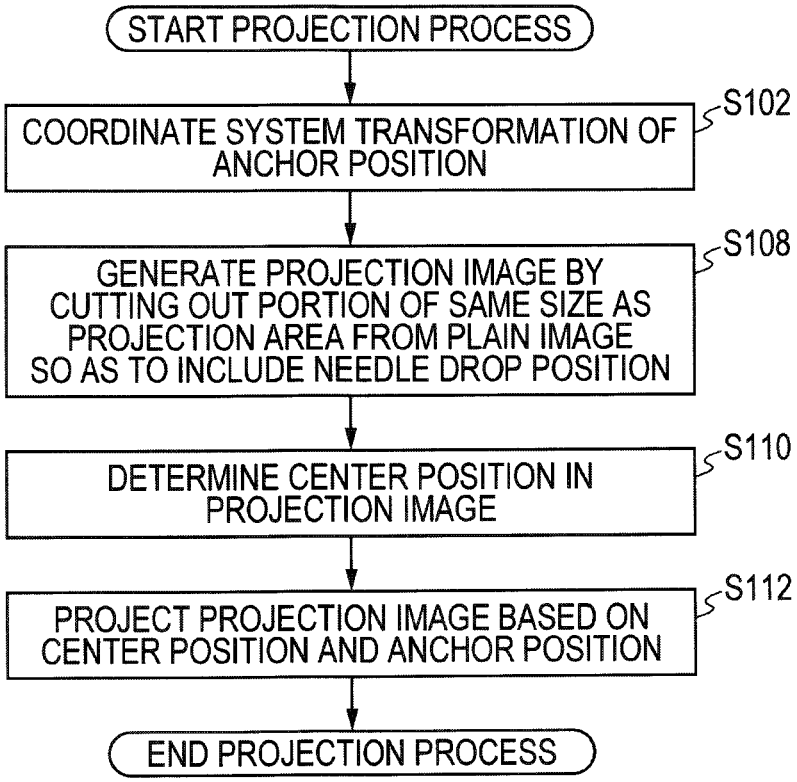
FIG. 8 is a flowchart showing a projection process of the sewing machine 1.

The operation of the projection process that is performed by the sewing machine 1 will be described in accordance with the flowchart of FIG. 8. The CPU 210 of the sewing machine 1 performs each process of the series of processes indicated by S102 to S112 in FIG. 8.

The CPU 210 acquires the anchor position coordinates of the captured image coordinate system stored in the anchor position storage portion 223. The CPU 210 transforms the anchor position coordinates of the captured image coordinate system into the anchor position coordinates of the sewing machine coordinate system (S102). The CPU 210 stores the anchor position coordinates of the sewing machine coordinate system in the anchor position storage portion 223.

The CPU 210 cuts out an image having the same size as the projection area PA from the plain image PG1 so as to include the needle drop position NP1 and the center position CP1, thereby generating the projection image PAG1 (S108). As shown in FIG. 7, the CPU 210 extracts, from the plain image PG1, an image having the same size as the projection area PA and indicating a part of the circular stitching pattern image SG1, such that the projection area PA includes the needle drop position NP1 and the center position CP1 and a region upstream of the needle drop position NP1 in the feed direction (the lower side of the needle drop position NP1 in FIG. 7), thereby generating the projection image PAG1. The projection image PAG1 is an image shown in FIG. 9. The CPU 210 stores the generated projection image PAG1 in the image storage portion 221.

The CPU 210 determines the center position coordinates in the projection image PAG1 stored in the image storage portion 221 (S110). The CPU 210 transforms the center position coordinates of the plain image stored in the center position storage portion 227, that is, the center position coordinates of the plain coordinate system, into the center position coordinates of the projection coordinate system via the sewing machine coordinate system, thereby determining the center position coordinates. The determined coordinates of the center position of the projection image PAG1 are stored in the center position storage portion 227.

The CPU 210 controls the projector 58 to project the projection image PAG1 toward the bed 2 (S112). First, the CPU 210 transforms the center position coordinates of the projection image PAG1 stored in the center position storage portion 227 into the center position coordinates of the sewing machine coordinate system. After the transformation, the CPU 210 determines the projection position of the projection image PAG1 on the bed 2 such that the transformed center position coordinates of the sewing machine coordinate system of the projection image PAG1 coincide with the anchor position coordinates of the sewing machine coordinate system stored in the anchor position storage portion 223. The CPU 210 controls the projector 58 to project the projection image PAG1. Thereafter, the CPU 210 ends the projection process.

<Sewing Process>

The operation of the sewing process that is performed by the sewing machine 1 will be described in accordance with the flowchart of FIG. 10. The CPU 210 of the sewing machine 1 performs each of the processes of the series of processes indicated by S202 to S216 in FIG. 10.

The CPU 210 initializes a counter n to 1 (S202). The counter n is a variable representing the number of unit patterns TP that have been sewn currently in the circular stitching pattern SP.

The CPU 210 reads and acquires the sewing data stored in the sewing data storage portion 222 (S204).

The CPU 210 forms one stitch of the unit pattern TP based on the sewing data (S206).

The CPU 210 redraws the plain image PG1 based on the sewing data (S208). The CPU 210 calculates a distance by which sewing has been processed, based on the feed amount data of the sewing data. Based on the distance by which sewing has been processed, the CPU 210 rotates the circular stitching pattern image SG1 of the plain image PG1 stored in the image storage portion 221 about the center position CP1, and redraws the plain image PG1. The redrawn plain image PG1 is stored in the image storage portion 221. Due to the rotation based on the feed amount data, the needle drop position of the redrawn plain image PG1 is not changed in the Y-axis direction and, in the X-axis direction, is changed to the position coordinates of one of the needle drop points based on the swing amount data. The position coordinates of the needle drop points are acquired by reading the position coordinates of the needle drop points stored in the needle drop point storage portion 203 and transforming the position coordinates from the sewing machine coordinate system into the plain coordinate system.

The CPU 210 performs the projection process described above (S210).

The CPU 210 determines whether one unit pattern TP has been sewn (S212). The CPU 210 determines whether all the acquired sewing data have been processed, that is, whether all the stitches included in the unit pattern TP have been sewn. In response to determining that all the stitches included in the unit pattern TP have been sewn, that is, one unit pattern TP has been sewn (S212: YES), the CPU 210 advances the processing to S214. In response to determining that the stitches included in the unit pattern TP have not been sewn yet, that is, the unit pattern TP is still being sewn (S212: NO), the CPU 210 returns the processing to S206.

Figure 11:
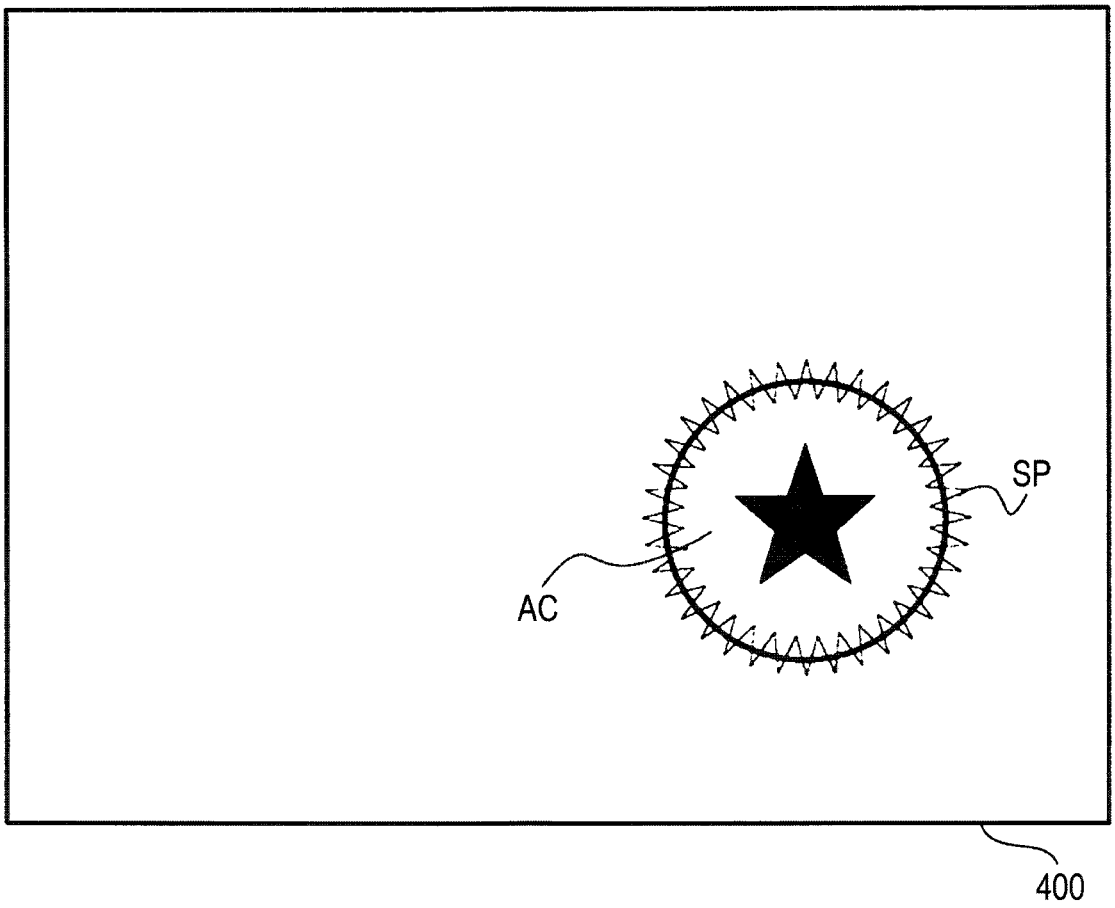
FIG. 11 is a plan view of a sewing workpiece 400 on which an applique AC is sewn by a circular stitching pattern SP.

In response to determining that one unit pattern TP has been sewn (S212: YES), the CPU 210 determines whether the counter n and the number of patterns N stored in the number-of-patterns storage portion 226 match (S214). In response to determining that the counter n and the number of patterns N match (S214: YES), the CPU 210 ends the sewing process. FIG. 11 shows a state where a circular applique AC with a star mark is sewn on the sewing workpiece 400 by the circular stitching pattern SP. In response to determining that the counter n and the number of patterns N do not match (S214: NO), the CPU 210 advances the processing to S216.

In response to determining that the counter n and the number of patterns N do not match (S214: NO), the CPU 210 increments the counter n by 1 (S216). By incrementing the counter n by 1, the CPU 210 returns the processing to S204 for starting the sewing of the next unit pattern TP.

In the present embodiment, the circular stitching pattern image SG1 of the actual size is projected in S112. The user accurately confirms a part of the circular stitching pattern SP in the actual size by viewing the projection image. That is, the user confirms the actual size of the circular stitching pattern SP with respect to the sewing workpiece 400. Before the start of sewing, that is, when it is determined in S44 that the user has not instructed to start sewing, the processing is returned to S8, which enables the user to easily adjust the size of the circular stitching pattern SP and to reduce a situation in which the circular stitching pattern SP that has been sewn is different from the assumed one.

In the present embodiment, in the processing of S12 to S24, even when the sewing workpiece 400 is not positioned on the circular stitching device 100, the indicator 140 is identified, and the shape of the circular stitching pattern SP is displayed on the display 11. This enables the user to confirm the shape of the circular stitching pattern SP without taking the trouble of positioning the sewing workpiece 400 on the circular stitching device 100.

In the present embodiment, in S12 or S28, the radius R1 is determined by image recognition of the captured image. Thus, the user does not need to input the radius R1, and thus, it does not take time and effort. Further, the possibility of occurrence of human errors such as user's input errors is reduced.

Figure 10:
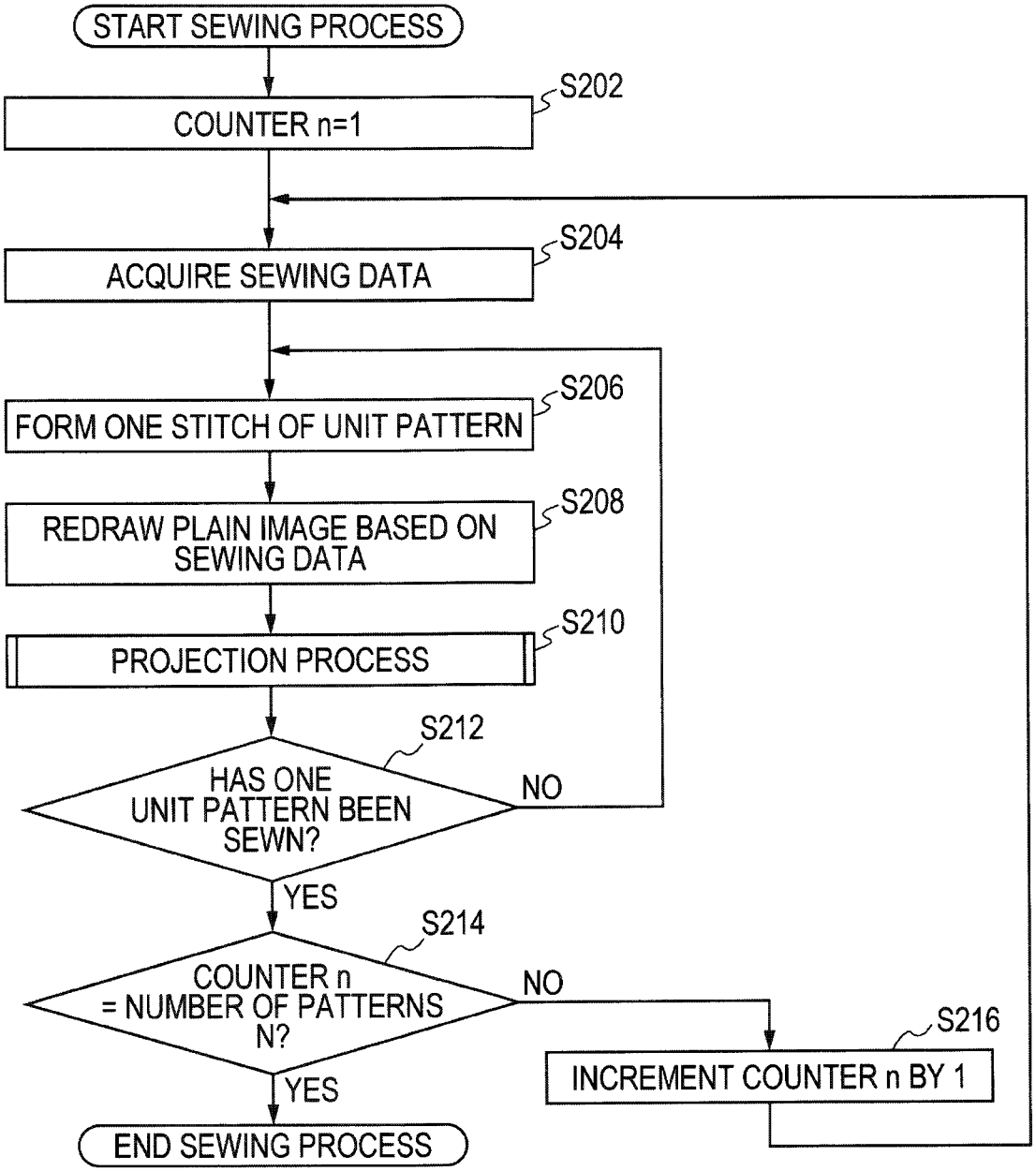
FIG. 10 is a flowchart showing a sewing process of the sewing machine 1.

In the present embodiment, in the sewing process shown in FIG. 10, the projection process is performed each time a stitch is formed. This enables the user to confirm the projection image that accurately represents the current sewing state.

Figure 9:
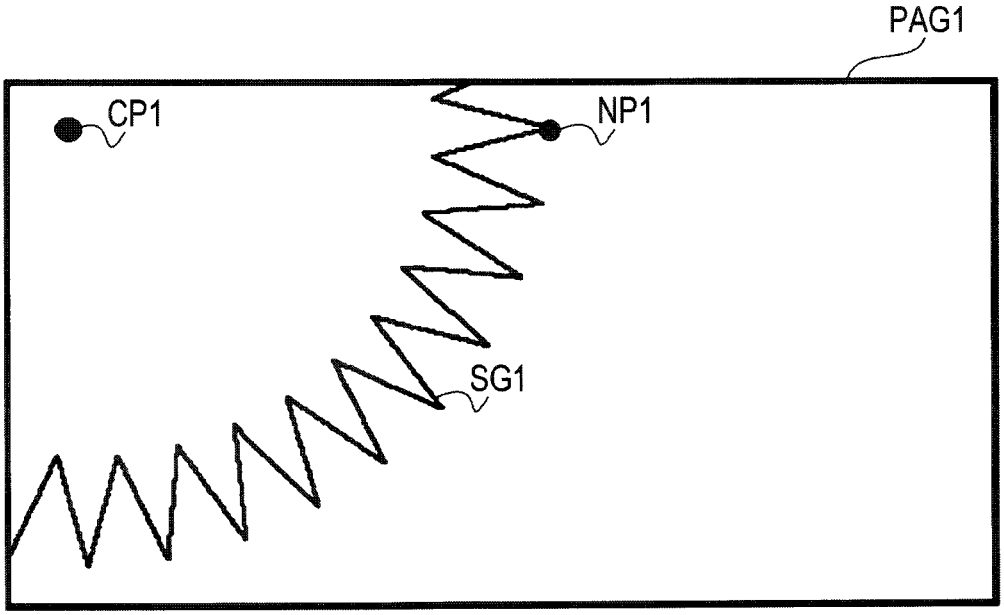
FIG. 9 is an explanatory diagram showing a projection image PAG1 including a circular stitching pattern image SG1.

In the present embodiment, as shown in FIG. 9, the projection image PAG1 is projected so as to include the needle drop position NP1. This enables the user to accurately confirm the position where the circular stitching pattern SP is arranged in the vicinity of the needle drop position NP1 (sewing start position) on the sewing workpiece 400. For example, as shown in FIG. 11, in a case where the applique AC is sewn on the sewing workpiece 400, the user accurately confirms the arrangement position of the circular stitching pattern SP with respect to the applique AC on the sewing workpiece 400 by using the needle drop position NP1 as the reference.

According to the sewing machine 1, the image representing the circular stitching pattern SP to be sewn, which is of an actual size, is projected by the projector 58. This enables the user to easily confirm the actual size of the circular stitching pattern SP to be sewn before sewing.

According to the sewing machine 1, even if the circular stitching pattern SP has a size that exceeds the projection area, the user checks a portion of the circular stitching pattern in the actual size in the vicinity of the needle drop position. This enables the user to imagine the actual size of the circular stitching pattern SP based on the planned sewing position of the circular stitching pattern SP on the sewing workpiece 400 and the image representing the projected part of the circular stitching pattern SP.

According to the sewing machine 1, the size of the circular stitching pattern SP is determined by the distance between the anchor position and the needle drop position NP1. Thus, the sewing machine 1 accurately determine the size of the circular stitching pattern SP.

According to the sewing machine 1, the projection position of the projection image of the circular stitching pattern SP is determined based on the anchor position. Thus, the sewing machine 1 accurately projects the projection image of the circular stitching pattern SP at the anchor position where the sewing workpiece is anchored.

According to the sewing machine 1, in the circular stitching pattern SP represented by the projection image, the unit patterns TP are arranged in a circular shape with the needle drop position NP1 as the formation start point of the unit pattern TP. This enables the user to accurately confirm the formation position of the circular stitching pattern SP to be actually sewn, based on the needle drop position NP1 that is the formation start point of the unit pattern TP.

According to the sewing machine 1, the unit pattern image is generated based on the sewing data of the unit pattern TP, and the generated unit pattern images are arranged in a circular shape. Thus, the projection image of the circular stitching pattern SP adapted to the actual sewing shape and size is accurately generated.

If the projection image of the same circular stitching pattern as that before the sewing is continued to be projected during the sewing, a large deviation may occur between the projection image of the circular stitching pattern that is projected and the stitches that are actually sewn. According to the sewing machine 1, the projection image of the circular stitching pattern SP projected during sewing is sequentially changed (updated) so as to represent the formation state of the stitches. This reduces, during sewing, the deviation between the projection image of the circular stitching pattern that is projected and the actual stitches, which enables the user to confirm the projection image of the accurate circular stitching pattern SP during sewing.

According to the sewing machine 1, after the projection image is projected, it is determined whether to start sewing. This enables the user to check whether the projection image of the circular stitching pattern to be projected has a desired shape and is located at a desired formation position, and if the projection image is the projection image of the desired circular stitching pattern, the user can immediately start sewing. If the projection image is not the projection image of the desired circular stitching pattern, for example, the user can change the anchor position such as the position of the pivot pin and perform the processing again.

Figure 12:
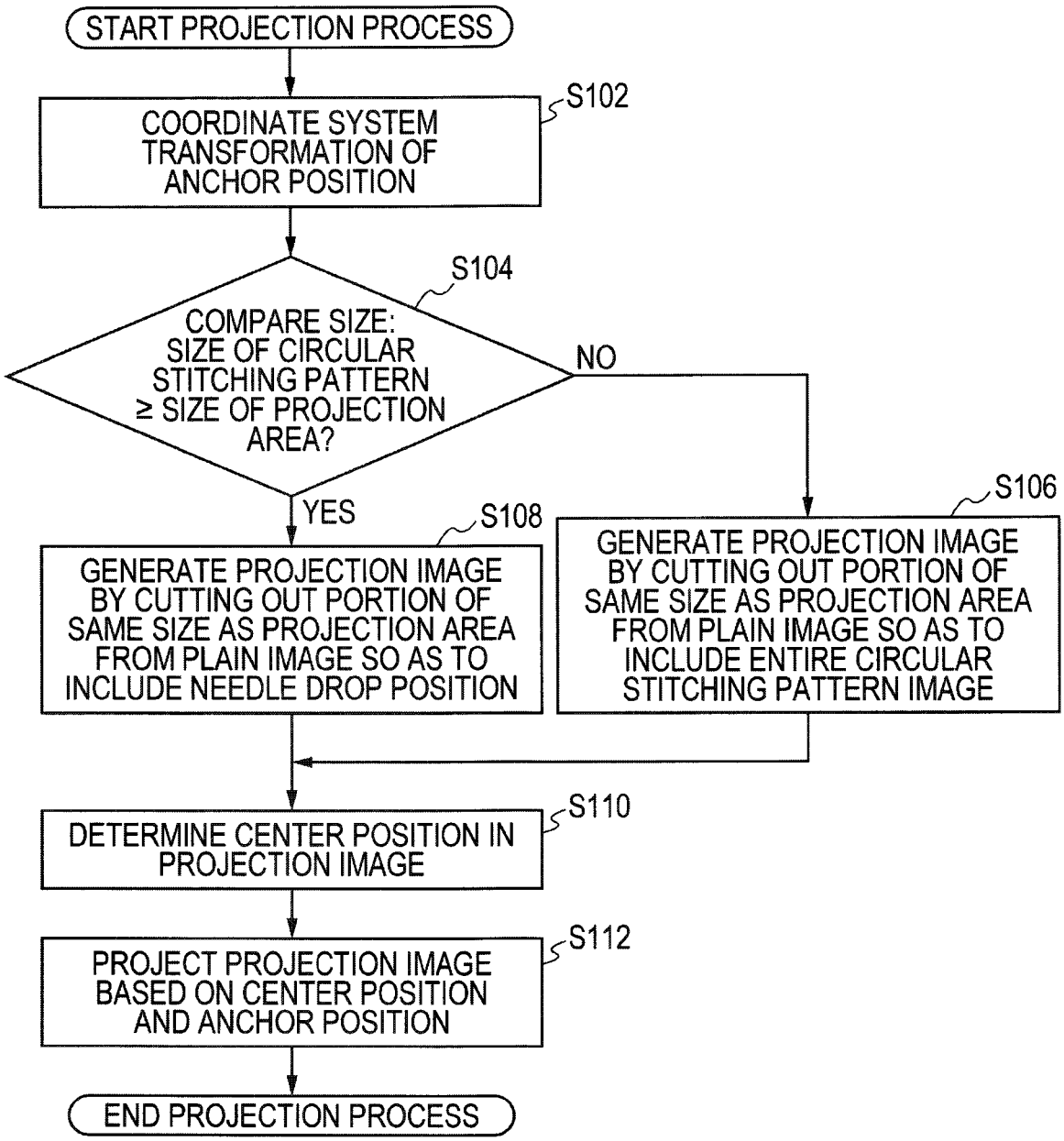
FIG. 12 is a flowchart showing a projection process of the sewing machine 1.
Figure 13:
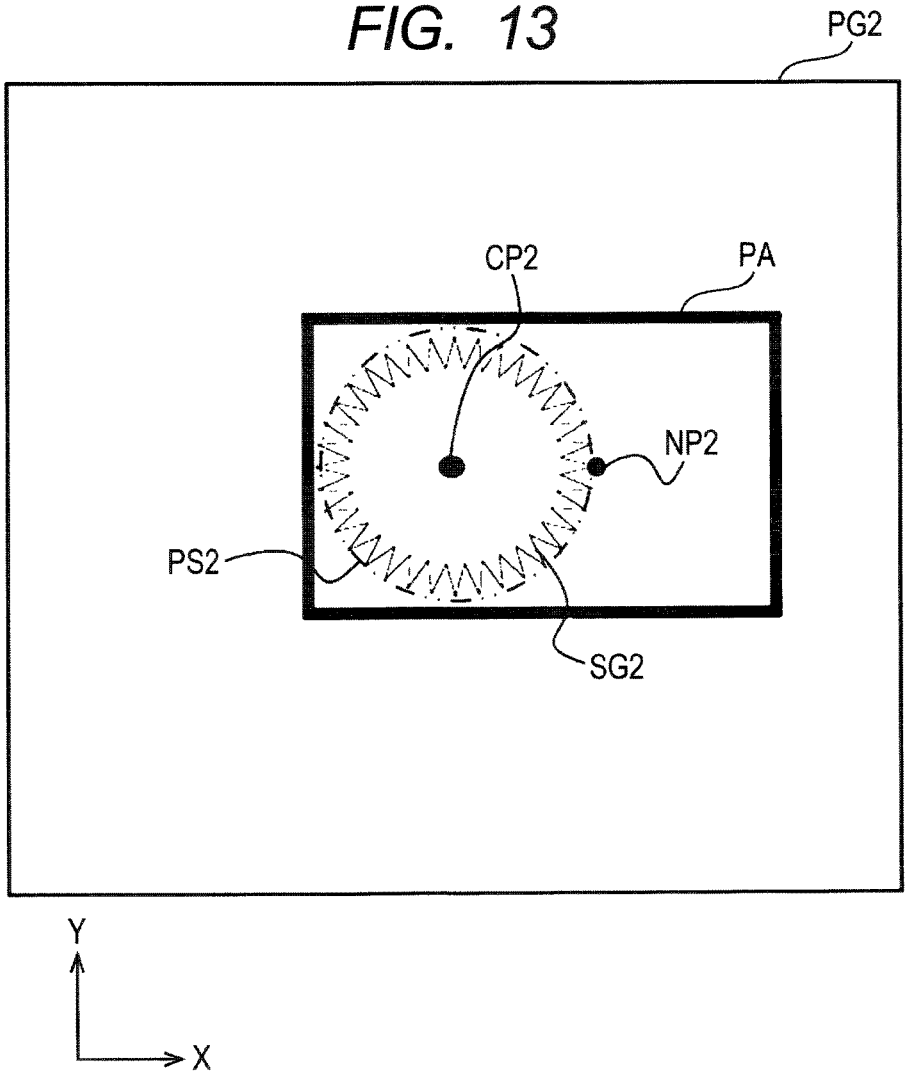
FIG. 13 is an explanatory diagram showing a plain image PG2 including a circular stitching pattern image SG2 formed along a circumference of a circle PS2.
Figure 14:
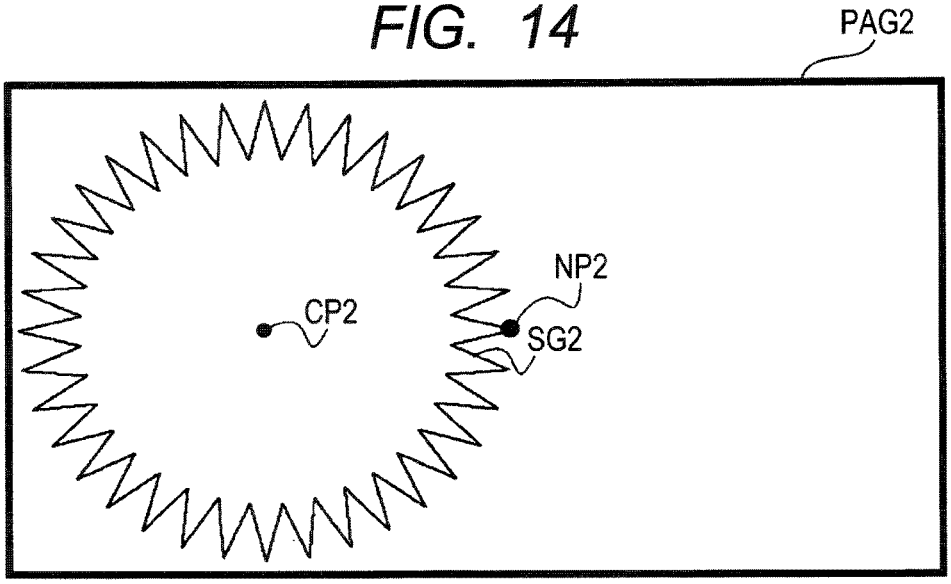
FIG. 14 is an explanatory diagram showing a projection image PAG2 including the circular stitching pattern image SG2.

The sewing machine 1 shown in FIG. 1 is an example of a sewing machine of the present disclosure. The circular stitching device 100 shown in FIG. 3 is an example of a circular stitching device of the present disclosure. The circular stitching pattern SP shown in FIG. 11 is an example of a circular stitching pattern of the present disclosure. The bed 2 shown in FIG. 1 is an example of a bed of the present disclosure. The projector 58 shown in FIG. 2 is an example of a projector of the present disclosure. The CPU 210 shown in FIG. 4 is an example of a controller of the present disclosure. The processing of S12 and S28 shown in FIG. 5 is an example of a size determination process of the present disclosure. The unit pattern TP shown in FIG. 6 is an example of a unit pattern of the present disclosure. The processing of S2 shown in FIG. 5 is an example of a pattern identification process of the present disclosure. The processing of S108 shown in FIG. 8 and the processing of S106 shown in FIG. 12 are examples of a projection image generation process of the present disclosure. The projection image PAG1 shown in FIG. 9 and a projection image PAG2 shown in FIG. 14 are examples of a projection image of the present disclosure. The processing of S112 shown in FIGS. 8 and 12 is an example of a projection control process of the present disclosure. The needle drop position NP1 shown in FIGS. 7 and 9 and a needle drop position NP2 shown in FIGS. 13 and 14 are examples of a needle drop position of the present disclosure. The processing of S10 and S26 shown in FIG. 5 is an example of an anchor position acquisition process of the present disclosure. The processing of S4 shown in FIG. 5 is an example of a sewing data acquisition process of the present disclosure. The processing of S32 shown in FIG. 5 is an example of a unit pattern image generation process of the present disclosure. The feed mechanism 51 shown in FIG. 4 is an example of a feeder of the present disclosure. The needle bar up-down movement mechanism 55 shown in FIG. 4 is an example of a sewing device of the present disclosure. The processing of S208 shown in FIG. 10 is an example of an image changing process of the present disclosure. The start-stop switch 13 and the touch panel 12 shown in FIG. 1 are examples of an input interface of the present disclosure. The processing of S44 shown in FIG. 5 is an example of a determination process of the present disclosure. The processing of YES in S44 shown in FIG. 5 is an example of a sewing start process of the present disclosure. The processing of NO in S44 shown in FIG. 5 is an example of a re-execution process of the present disclosure. The main program stored in the main program storage portion 201 shown in FIG. 4 is an example of a program of the present disclosure.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described invention are provided below.

(1) In the present embodiment, in S112, the projection position of the projection image PAG1 is determined based on the position of the pivot pin 150, that is, the anchor position, and the center position CP1 of the projection image PAG1. But the present disclosure is not limited to this configuration. For example, the projection position of the projection image PAG1 may be determined based on the needle drop position on the bed 2 and the needle drop position NP1 of the projection image PAG1.

(2) In the present embodiment, in S12 and S28, the needle drop position NP1 in the captured image is determined by acquiring the position coordinates stored in the needle drop point storage portion 203 of the ROM 200, but the present disclosure is not limited to this configuration. For example, the needle drop position NP1 in the captured image may be determined using a known image recognition, as in the case of determining the positions of the indicator 140 and the pivot pin 150. For example, in this configuration, the needle drop position NP1 is determined by identifying the image of the sewing needle 7 in the captured image.

(3) In the present embodiment, in S12 and S28, the radius R1 is calculated as the length between the needle drop position NP1 and the anchor position, but the present disclosure is not limited to this configuration. For example, the radius R1 may be specified by the user's operation on the touch panel 12 to input the value of the radius R1.

(4) In the present embodiment, in S110, the center position CP1 in the projection image PAG1 is derived based on the center position CP1 of the circle PS1 in the plain image PG1, but the present disclosure is not limited to this configuration. For example, a known image recognition technique may be used as in the case of determining the positions of the indicator 140 and the pivot pin 150. Specifically, the center position CP1 in the projection image PAG1 may be determined by recognizing a black point representing the center position CP1 in the projection image PAG1 generated by the processing of S108.

(5) In the present embodiment, in S108, the projection image PAG1 is generated by cutting out the same size as the projection area PA from the plain image PG1. But the present disclosure is not limited to this configuration. For example, without generating the plain image PG1, the projection image PAG1 having the same size as the projection area PA may be generated from data such as the radius R1, the unit pattern TP, the anchor position, and the needle drop position NP1.

(6) In the present embodiment, in S206 to S210, the projection process is performed each time one stitch of the unit pattern TP is formed, but the present disclosure is not limited to this configuration. For example, the projection process may be performed each time a particular number of stitches of the unit pattern are formed, the particular number being two or more. Further, the projection process may be performed each time a particular time elapses from the start of sewing.

(7) In the present embodiment, the projector 58 projects an image substantially directly downward as shown in FIG. 2, but the present disclosure is not limited to this configuration. For example, the projection may be performed obliquely depending on the position where the projector 58 is arranged. In this case, in S16 to S20, S32 to S36, and so on, image processing may be performed to reduce distortion of the circular shape of the projection image PAG1 of the circular stitching pattern SP.

(8) In the present embodiment, the circular stitching pattern image SG1 to be projected includes the needle drop position NP1, but the present disclosure is not limited to this configuration. For example, the circular stitching pattern image SG1 may be an image representing at least a part of the circular stitching pattern SP, and the circular stitching pattern image SG1 may not include the needle drop position NP1.

(9) In the present embodiment, in a case where the indicator 140 is identified, that is, in a case where the sewing workpiece 400 is not set, the projection process is not performed after S24, but the present disclosure is not limited to this configuration. For example, similarly to the processing of S40 to S42, the projection process of S42 may be performed after S24. In this configuration, when the indicator 140 is identified in S10 (S10: YES), the CPU 210 stores, in the anchor position storage portion 223, the position coordinates of the through hole 141 of the indicator 140 in the captured image coordinate system as the anchor position.

According to this modification, even when the sewing workpiece 400 is not set, an image representing the circular stitching pattern SP is projected onto the bed 2. This enables the user to check the size and the shape of the circular stitching pattern SP to be sewn without the need to perform the work of setting the sewing workpiece 400.

(10) In the present embodiment, as in the projection image PAG1 shown in FIG. 9, the projection area PA projected by the projector 58 is arranged on the upstream side in the feed direction from the needle drop position NP1. But the present disclosure is not limited to this configuration. For example, as in the projection image PAG2 shown in FIG. 14, the projection image may be projected to the upstream side and the downstream side in the feed direction from the needle drop position NP2. In this configuration, a projection process shown in FIG. 12 is performed as the projection process. The projection process shown in FIG. 12 will be described. For S102 and S108 to S112, the same processing as the projection process shown in FIG. 8 is performed.

The CPU 210 determines whether the size of the circular stitching pattern SP is larger than or equal to the size of the projection area PA (S104). The size of the circular stitching pattern SP is obtained by calculating the diameter from the radius R1. The CPU 210 compares the diameter of the circular stitching pattern SP with the length of the short side of the projection area PA. When the diameter of the circular stitching pattern SP is larger than or equal to the length of the short side of the projection area PA, the CPU 210 determines that the size of the circular stitching pattern SP is larger than or equal to the size of the projection area PA. When the diameter of the circular stitching pattern SP is smaller than the length of the short side of the projection area PA, the CPU 210 determines that the size of the circular stitching pattern SP is smaller than the size of the projection area PA. In response to determining that the size of the circular stitching pattern SP is larger than or equal to the size of the projection area PA (S104: YES), the CPU 210 advances the processing to S108. In response to determining that the size of the circular stitching pattern SP is smaller than the size of the projection area PA (S104: NO), the CPU 210 advances the processing to S106.

In response to determining that the size of the circular stitching pattern SP is smaller than the size of the projection area PA (S104: NO), the CPU 210 cuts out an image having the same size as the projection area PA from the plain image PG2 so as to include the entire circular stitching pattern image SG2, and generates the projection image PAG2 (S106). When the size of the circular stitching pattern SP is smaller than the size of the projection area PA, the entire circular stitching pattern image SG2 is contained in the projection area PA. As shown in FIG. 13, the CPU 210 extracts an image having the same size as the projection area PA such that the entire circular stitching pattern image SG2 fits in the projection area PA, and generates the projection image PAG2. The projection image PAG2 is an image shown in FIG. 14. The CPU 210 stores the generated projection image PAG2 in the image storage portion 221.

According to this modification, when the size of the circular stitching pattern SP is larger than or equal to the size of the projection area PA, the projection image PAG1 representing a part of the circular stitching pattern image SG1 as shown in FIG. 9 is projected. When the size of the circular stitching pattern SP is smaller than the size of the projection area PA, the projection image PAG2 representing the entire circular stitching pattern image SG2 is projected as shown in FIG. 14. Thus, when the size of the circular stitching pattern SP is smaller than the size of the projection area PA, the user confirms the entire image of the circular stitching pattern SP to be sewn, thereby more accurately grasping the size and the shape of the circular stitching pattern SP. When the size of the circular stitching pattern SP is larger than or equal to the size of the projection area PA, the user confirms a part of the circular stitching pattern SP in the actual size, and imagines the actual size of the circular stitching pattern SP based on the image representing the part of the circular stitching pattern SP, as in the present embodiment.

What is claimed is:

1. A sewing machine comprising:

a bed to which a circular stitching device is attachable, the circular stitching device configured to anchor a sewing workpiece in a rotatable manner at an anchor position that is apart from a needle drop position of a sewing needle by a distance corresponding to a size of a circular stitching pattern to be formed on the sewing workpiece;

a projector configured to project a projection image toward the bed; and a controller configured to perform:

controlling the projector to project the projection image representing at least part of the circular stitching pattern of the size to be formed on the sewing workpiece, the circular stitching pattern being formed by continuously arranging a unit pattern in a circular shape.

2. The sewing machine according to claim 1, wherein the controller is configured to perform:

determining the size of the circular stitching pattern;

identifying the unit pattern that forms the circular stitching pattern;

generating the projection image representing at least part of the circular stitching pattern having the determined size, the circular stitching pattern being formed by continuously arranging the identified unit pattern in a circular shape; and controlling the projector to project the generated projection image.

3. The sewing machine according to claim 2, wherein the controller is configured to perform:

generating the projection image representing a part of the circular stitching pattern, the projection image including the needle drop position, the projection image having a same size as a projection area representing an area that is projected by the projector, the projection area being set at a particular position on the bed.

4. The sewing machine according to claim 2, wherein the controller is configured to perform:

controlling the projector to project the projection image in which the needle drop position is located on a circular image formed by continuously arranging the unit pattern.

5. The sewing machine according to claim 2, wherein the projection image is an image representing the circular stitching pattern formed by continuously arranging the unit pattern in a circular shape from the needle drop position as a formation start point of the unit pattern.

6. The sewing machine according to claim 2, wherein the controller is configured to perform:

acquiring sewing data for sewing the unit pattern;

generating a unit pattern image representing the unit pattern based on the acquired sewing data; and generating the projection image by arranging the generated unit pattern image in a circular shape.

7. The sewing machine according to claim 2, further comprising:

a feed dog configured to feed the sewing workpiece in a particular feed direction, wherein the controller is configured to perform:

sewing stitches on the sewing workpiece fed by the feed dog by moving the sewing needle up and down;

when the circular stitching pattern is being sewn, sequentially changing a content of the projection image such that the projection image represents a formation state of stitches formed by the sewing needle; and when the circular stitching pattern is being sewn, controlling the projector to project the changed projection image.

8. The sewing machine according to claim 7, wherein the controller is configured to perform:

each time a particular number of stitches are formed, changing the content of the projection image such that the projection image represents the formation state of stitches by the sewing needle, and controlling the projector to project the changed projection image.

9. The sewing machine according to claim 2, further comprising:

a feed dog configured to feed the sewing workpiece in a particular feed direction; and an input interface for inputting input data after the projection image is projected, the input data indicating whether to start sewing, wherein the controller is configured to perform:

determining whether to start the sewing based on the input data input via the input interface;

in response to determining that the sewing is to be started, starting the sewing on the sewing workpiece fed by the feed dog by moving the sewing needle up and down; and in response to determining that the sewing is not to be started, redetermining at least the size of the circular stitching pattern.

10. The sewing machine according to claim 1, wherein the controller is configured to perform:

determining the size of the circular stitching pattern based on a distance between the anchor position and the needle drop position.

11. The sewing machine according to claim 1, wherein the controller is configured to perform:

acquiring the anchor position; and determining a projection position of the projection image based on the acquired anchor position, and controlling the projector to project the projection image.

12. The sewing machine according to claim 1, wherein the controller is configured to perform:

identifying, as the anchor position, an indicator provided on the circular stitching device or a pivot pin used for anchoring the sewing workpiece on the circular stitching device.

13. The sewing machine according to claim 12, wherein the controller is configured to perform, before sewing the circular stitching pattern:

in response to determining that the indicator is identified, not controlling the projector to project the projection image; and in response to determining that the pivot pin is identified, controlling the projector to project the projection image.

14. A non-transitory computer-readable storage medium storing a set of program instructions for a sewing machine comprising a bed to which a circular stitching device is attachable, a projector configured to project a projection image toward the bed, and a controller, the set of program instructions, when executed by the controller, causing the sewing machine to perform:

determining a size of a circular stitching pattern, the circular stitching device being configured to anchor a sewing workpiece in a rotatable manner at an anchor position that is apart from a needle drop position of a sewing needle by a distance corresponding to the size of the circular stitching pattern to be formed on the sewing workpiece;

identifying a unit pattern that forms the circular stitching pattern;

generating the projection image representing at least part of the circular stitching pattern having the determined size, the circular stitching pattern being formed by continuously arranging the identified unit pattern in a circular shape; and controlling the projector to project the projection image.

15. The non-transitory computer-readable storage medium according to claim 14, wherein the set of program instructions, when executed by the controller, causes the sewing machine to perform:

generating the projection image representing a part of the circular stitching pattern, the projection image including the needle drop position and having a same size as a projection area of the projector.

16. The non-transitory computer-readable storage medium according to claim 14, wherein the set of program instructions, when executed by the controller, causes the sewing machine to perform:

controlling the projector to project the projection image in which the needle drop position is located on a circular image formed by continuously arranging the unit pattern.

17. The non-transitory computer-readable storage medium according to claim 14, wherein the set of program instructions, when executed by the controller, causes the sewing machine to perform:

determining the size of the circular stitching pattern based on a distance between the anchor position and the needle drop position.

18. The non-transitory computer-readable storage medium according to claim 14, wherein the set of program instructions, when executed by the controller, causes the sewing machine to perform:

acquiring the anchor position; and determining a projection position of the projection image based on the acquired anchor position, and controlling the projector to project the projection image.

19. The non-transitory computer-readable storage medium according to claim 14, wherein the projection image is an image representing the circular stitching pattern formed by continuously arranging the unit pattern in a circular shape from the needle drop position as a formation start point of the unit pattern.

20. The non-transitory computer-readable storage medium according to claim 14, wherein the set of program instructions, when executed by the controller, causes the sewing machine to perform:

acquiring sewing data for sewing the unit pattern;

generating a unit pattern image representing the unit pattern based on the acquired sewing data; and generating the projection image by arranging the generated unit pattern image in a circular shape.

* * * * *